US010997898B2

(12) United States Patent
Wang et al.

(10) Patent No.: US 10,997,898 B2
(45) Date of Patent: May 4, 2021

(54) COMPENSATION METHOD AND SYSTEM FOR DISPLAY PANEL, AND DISPLAY DEVICE

(71) Applicant: BOE TECHNOLOGY GROUP CO., LTD., Beijing (CN)

(72) Inventors: Lirong Wang, Beijing (CN); Fei Yang, Beijing (CN); Yi Chen, Beijing (CN); Yu Wang, Beijing (CN); Mingi Chu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/007,120

(22) Filed: Aug. 31, 2020

(65) Prior Publication Data

US 2020/0402446 A1 Dec. 24, 2020

Related U.S. Application Data

(63) Continuation-in-part of application No. PCT/CN2019/127415, filed on Dec. 23, 2019.

(30) Foreign Application Priority Data

Feb. 1, 2019 (CN) ..... 201910104408.6

(51) Int. Cl.
*G09G 3/20* (2006.01)
*G09G 3/3291* (2016.01)

(52) U.S. Cl.
CPC ..... *G09G 3/2074* (2013.01); *G09G 3/3291* (2013.01); *G09G 2310/027* (2013.01);
(Continued)

(58) Field of Classification Search
CPC ..... G09G 3/2074; G09G 3/3291; G09G 2320/045; G09G 2330/10; G09G 2310/08; G09G 2320/048; G09G 2310/027
See application file for complete search history.

(56) References Cited

U.S. PATENT DOCUMENTS 6,552,735 B1 4/2003 Dehmlow
2010/0225634 A1* 9/2010 Levey ..... G09G 3/3208 345/212
(Continued)

FOREIGN PATENT DOCUMENTS

CN 101477783 A 7/2009
CN 105096829 A 11/2015
(Continued)

OTHER PUBLICATIONS

First Office Action dated Mar. 20, 2020 for application No. CN201910104408.6 with English translation attached.
(Continued)

*Primary Examiner* — Andrew Sasinowski
(74) *Attorney, Agent, or Firm* — Nath, Goldberg & Meyer; Joshua B. Goldberg

(57) ABSTRACT

The present disclosure provides a compensation method for a display panel, a compensation system for a display panel, and a display device. The display panel includes a plurality of sub-pixels, and the compensation method includes: respectively determining a current aging degree coefficient of each sub-pixel according to historical display data of the sub-pixel; and, for each sub-pixel, performing aging compensation on the sub-pixel according to the current aging degree coefficient of the sub-pixel when a current frame is displayed. The present disclosure further provides a compensation system for a display panel, and a display device.

14 Claims, 7 Drawing Sheets

(52) U.S. Cl.
CPC ... *G09G 2310/08* (2013.01); *G09G 2320/045* (2013.01); *G09G 2320/048* (2013.01); *G09G 2330/10* (2013.01)

(56) References Cited

U.S. PATENT DOCUMENTS

| | | | | |
|---|---|---|---|---|
| 2010/0277400 | A1* | 11/2010 | Jeong | G09G 3/3275 345/76 |
| 2013/0135272 | A1* | 5/2013 | Park | G09G 3/3233 345/211 |
| 2013/0321361 | A1* | 12/2013 | Lynch | H01L 27/3225 345/204 |
| 2014/0055500 | A1* | 2/2014 | Lai | G09G 3/3225 345/690 |
| 2014/0111567 | A1* | 4/2014 | Nathan | G09G 3/3233 345/694 |
| 2014/0267372 | A1* | 9/2014 | Chaji | G09G 3/006 345/606 |
| 2016/0307498 | A1* | 10/2016 | Chaji | G09G 3/3291 |
| 2016/0379551 | A1* | 12/2016 | Zhuang | G09G 3/3208 345/520 |
| 2018/0357954 | A1 | 12/2018 | Lynch et al. | |

FOREIGN PATENT DOCUMENTS

| | | | |
|---|---|---|---|
| CN | 105185291 | A | 12/2015 |
| CN | 105741762 | A | 7/2016 |
| CN | 105895056 | A | 8/2016 |
| CN | 106601167 | A | 4/2017 |
| CN | 107424561 | A | 12/2017 |
| CN | 107909964 | A | 4/2018 |
| CN | 108962135 | A | 12/2018 |
| CN | 108962140 | A | 12/2018 |
| CN | 109147672 | A | 1/2019 |
| CN | 109584797 | A | 4/2019 |

OTHER PUBLICATIONS

International Search Report Form PCT/ISA/210 for corresponding international application PCT/CN2019/1227415, with English translation.

* cited by examiner

COMPENSATION METHOD AND SYSTEM FOR DISPLAY PANEL, AND DISPLAY DEVICE

CROSS-REFERENCE TO RELATED APPLICATION

The present application claims the priority of Patent Application No. 201910104408.6 filed to the China Patent Office on Feb. 1, 2019, the entire contents of which are incorporated herein by reference in their entirety.

TECHNICAL FIELD

The present disclosure relates to the technical field of display technology, and in particular, to a compensation method and compensation system for a display panel, and a display device.

BACKGROUND

In an Organic Light-Emitting Diode (OLED) display device, the problems of reduced service life of OLEDs and aging of OLEDs come up as the usage time of OLED devices increases.

SUMMARY

As a first aspect, a method for compensating a display panel is provided. The display panel includes a plurality of sub-pixels. The method includes respectively determining a current aging degree coefficient of each sub-pixel according to historical display data of the sub-pixel; and for each sub-pixel, performing aging compensation on the sub-pixel according to the current aging degree coefficient of the sub-pixel when a current frame is displayed.

In some embodiments, the history display data includes a theoretical grayscale of each sub-pixel in each of frames displayed on the display panel. The step of respectively determining the current aging degree coefficient of each sub-pixel according to the historical display data of the sub-pixel includes searching a preset first correspondence table for an aging contribution value corresponding to each theoretical grayscale in the historical display data, the first correspondence table storing different theoretical grayscales and aging contribution values corresponding the different theoretical grayscales; and for each sub-pixel, summing the aging contribution values corresponding to the theoretical grayscales of the sub-pixel in all the frames, and using the sum as the current aging degree coefficient of the sub-pixel.

In some embodiments, the step of performing aging compensation on the sub-pixel according to the current aging degree coefficient of the sub-pixel includes determining a current aging compensation parameter of the sub-pixel according to the current aging degree coefficient of the sub-pixel; generating a data voltage of the sub-pixel according to a theoretical grayscale of the sub-pixel in the current frame and the current aging compensation parameter of the sub-pixel; and outputting the data voltage to the sub-pixel to drive the sub-pixel.

In some embodiments, the current aging compensation parameter includes a grayscale compensation coefficient k1, the grayscale compensation coefficient k1 representing a ratio of an actual grayscale of the sub-pixel to the theoretical grayscale of the sub-pixel during the displaying of the current frame.

The step of determining the current aging compensation parameter of the sub-pixel according to the current aging degree coefficient of the sub-pixel includes determining the grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel.

The step of generating the data voltage of the sub-pixel according to the theoretical grayscale of the sub-pixel in the current frame and the current aging compensation parameter of the sub-pixel includes calculating a compensation grayscale (a) with a formula: a=INT(k1*G1) according to the grayscale compensation coefficient k1 of the sub-pixel and a theoretical grayscale G1 of the sub-pixel in the current frame, where INT (k1*G1) represents rounding k1*G1; determining an actual grayscale G2 of the sub-pixel in the current frame according to the compensation grayscale (a):

$$G2 = \begin{cases} a & a \le M \\ M & a > M \end{cases},$$

where M represents a preset maximum grayscale of the sub-pixel; and generating a data voltage corresponding to the actual grayscale G2 in a case where a Gamma voltage is a preset reference Gamma voltage.

In some embodiments, the current aging compensation parameter includes a Gamma voltage compensation coefficient k2, the Gamma voltage compensation coefficient k2 representing a ratio of an actual Gamma voltage of the sub-pixel during the displaying of the current frame to a preset reference Gamma voltage. The step of determining the current aging compensation parameter of the sub-pixel according to the current aging degree coefficient of the sub-pixel includes: determining the Gamma voltage compensation coefficient k2 of the sub-pixel according to the formula:

$$k2 = \sqrt{\frac{1}{(1-p)}},$$

where p represents the current aging degree coefficient of the sub-pixel, and γ represents a preset Gamma coefficient of the display panel.

The step of generating the data voltage of the sub-pixel according to the theoretical grayscale of the sub-pixel in the current frame and the current aging compensation parameter of the sub-pixel includes: calculating an actual Gamma voltage V2 of the sub-pixel in the current frame according to the Gamma voltage compensation coefficient k2 of the sub-pixel and a reference Gamma voltage V1, with V2=k2×V1; and generating the data voltage corresponding to the theoretical grayscale of the sub-pixel in the current frame in a case where a Gamma voltage is the actual Gamma voltage V2.

In some embodiments, the current aging compensation parameter includes a grayscale compensation coefficient k1 and a Gamma voltage compensation coefficient k2, the grayscale compensation coefficient k1 representing a ratio of an actual grayscale of the sub-pixel to the theoretical grayscale of the sub-pixel during the displaying of the current frame, and the Gamma voltage compensation coefficient k2 representing a ratio of an actual Gamma voltage of the sub-pixel during the displaying of the current frame to a preset reference Gamma voltage. The step of determining the current aging compensation parameter of the sub-pixel according to the current aging degree coefficient of the sub-pixel includes: determining a grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel; calculating a compensation grayscale (a) with the formula: a=INT(k1*G1) according to the grayscale compensation coefficient k1 of the sub-pixel and a theoretical grayscale G1 of the sub-pixel in the current frame, where INT(k1*G1) represents rounding k1*G1; determining whether the compensation grayscale (a) is less than or equal to a preset maximum grayscale M of the sub-pixel; and in response to that the compensation grayscale (a) is less than or equal to the maximum grayscale M, determining that the grayscale compensation coefficient k1 remains unchanged, and a Gamma voltage compensation coefficient k2 is equal to 1, an actual grayscale G2 of the sub-pixel in the current frame is equal to the compensation grayscale (a), and a grayscale voltage of the sub-pixel in the current frame is equal to a preset reference Gamma voltage V. The step of generating the data voltage of the sub-pixel according to the theoretical grayscale of the sub-pixel in the current frame and the current aging compensation parameter of the sub-pixel includes: generating a data voltage corresponding to the actual grayscale G2 in a case where a Gamma voltage is the preset reference Gamma voltage V1; in response to that the compensation grayscale (a) is greater than the maximum grayscale M determining that the grayscale compensation coefficient K is equal to 1, and the actual grayscale G2 of the sub-pixel in the current frame is equal to the theoretical grayscale G; and determining the Gamma voltage compensation coefficient k2 of the sub-pixel according to the formula:

$$k2 = \sqrt{\frac{1}{(1-p)}}.$$

The step of generating the data voltage of the sub-pixel according to the theoretical grayscale of the sub-pixel in the current frame and the current aging compensation parameter of the sub-pixel includes: calculating an actual Gamma voltage V2 of the sub-pixel in the current frame according to the Gamma voltage compensation coefficient k2 of the sub-pixel and the reference Gamma voltage V1, with V2=k2×V1; and generating the data voltage corresponding to the theoretical grayscale G1 in a case where the Gamma voltage is the actual Gamma voltage V2.

In some embodiments, before the step of performing aging compensation on the sub-pixel according to the current aging degree coefficient of the sub-pixel, the method further includes: for each sub-pixel, determining whether the current aging degree coefficient of the sub-pixel is greater than a predetermined aging degree coefficient threshold; and in response to that the current aging degree coefficient of the sub-pixel is not greater than a predetermined aging degree coefficient threshold, performing aging compensation on the sub-pixel according to the current aging degree coefficient of the sub-pixel; otherwise, determining that the sub-pixel is an abnormal sub-pixel.

As a second aspect, a system for compensating a display panel is provided in an embodiment of the present disclosure. The display panel includes a plurality of sub-pixels, and the system includes: an aging degree determination circuit configured to respectively determine a current aging degree coefficient of each sub-pixel according to historical display data of the sub-pixel; and an aging compensation circuit configured to, for each sub-pixel, perform aging compensation on the sub-pixel according to the current aging degree coefficient of the sub-pixel when a current frame is displayed.

In some embodiments, the historical display data includes a theoretical grayscale of each sub-pixel in each of frames displayed on the display panel. The aging degree determination circuit includes: a searching sub-circuit configured to search a preset first correspondence table for an aging contribution value corresponding to each theoretical grayscale in the historical display data, the first correspondence table storing different theoretical grayscales and aging contribution values corresponding the different theoretical grayscales; and a processing sub-circuit configured to, for each sub-pixel, sum the aging contribution values corresponding to the theoretical grayscales of the sub-pixel in all the frames, and use the sum as the current aging degree coefficient of the sub-pixel.

In some embodiments, the aging compensation circuit includes: a compensation coefficient determination sub-circuit configured to, for each sub-pixel, determine a current aging compensation parameter of the sub-pixel according to the current aging degree coefficient of the sub-pixel; a voltage generating sub-circuit configured to generate a data voltage of the sub-pixel according to a theoretical grayscale of the sub-pixel in the current frame and the current aging compensation parameter of the sub-pixel; and a driving sub-circuit configured to output the data voltage to the sub-pixel to drive the sub-pixel.

In some embodiments, the current aging compensation parameter includes a grayscale compensation coefficient k1, the grayscale compensation coefficient k1 representing a ratio of an actual grayscale of the sub-pixel to the theoretical grayscale of the sub-pixel during the displaying of the current frame. The compensation coefficient determination sub-circuit includes: a first determination circuit configured to determine the grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel. The voltage generating sub-circuit includes: a first calculation circuit configured to calculate a compensation grayscale (a) with the formula: a=INT(k1*G1) according to the grayscale compensation coefficient k1 of the sub-pixel and a theoretical grayscale G1 of the sub-pixel in the current frame, where INT(k1*G1) represents rounding k1*G1; a second determination circuit configured to determine an actual grayscale G2 of the sub-pixel in the current frame according to the compensation grayscale (a):

$$G2 = \begin{cases} a & a \le M \\ M & a > M \end{cases},$$

where M represents a preset maximum grayscale of the sub-pixel; and a first generation circuit configured to generate a data voltage corresponding to the actual grayscale G2 in a case where a Gamma voltage is a preset reference Gamma voltage.

In some embodiments, the current aging compensation parameter includes a Gamma voltage compensation coefficient k2, the Gamma voltage compensation coefficient k2 representing a ratio of an actual Gamma voltage of the sub-pixel during the displaying of the current frame to a preset reference Gamma voltage. The compensation coefficient determination sub-circuit includes: a third determination circuit configured to determine the Gamma voltage compensation coefficient k2 of the sub-pixel according to the formula:

$$k2 = \sqrt{\frac{1}{(1-p)}},$$

where p represents the current aging degree coefficient of the sub-pixel, and γ represents a preset Gamma coefficient of the display panel. The voltage generating sub-circuit includes a second calculation circuit configured to calculate an actual Gamma voltage V2 of the sub-pixel in the current frame according to the Gamma voltage compensation coefficient k2 of the sub-pixel and a reference Gamma voltage V1, wherein V2=k2×V1; and a second generation circuit configured to generate a data voltage corresponding to the theoretical grayscale of the sub-pixel in the current frame in a case where a Gamma voltage is the actual Gamma voltage V2.

In some embodiments, the current aging compensation parameter includes a grayscale compensation coefficient k1 and a Gamma voltage compensation coefficient k2, the grayscale compensation coefficient k1 representing a ratio of an actual grayscale of the sub-pixel to the theoretical grayscale of the sub-pixel during the displaying of the current frame, and the Gamma voltage compensation coefficient k2 representing a ratio of an actual Gamma voltage of the sub-pixel during the displaying of the current frame to a preset reference Gamma voltage. The compensation coefficient determination sub-circuit includes a fourth determination circuit configured to determine the grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel; a third calculation circuit configured to calculate a compensation grayscale (a) with the formula: a=INT(k1*G1) according to the grayscale compensation coefficient k1 of the sub-pixel and a theoretical grayscale G1 of the sub-pixel in the current frame, where INT(k1*G1) represents rounding k1*G1; a judgment circuit configured to determine whether the compensation grayscale (a) is less than or equal to a preset maximum grayscale M of the sub-pixel; a fifth determination circuit configured to determine, in response to that the compensation grayscale (a) is less than or equal to the maximum grayscale M, that the grayscale compensation coefficient k1 remains unchanged, the Gamma voltage compensation coefficient k2 is equal to 1, an actual grayscale G2 of the sub-pixel in the current frame is equal to the compensation grayscale (a), and a grayscale voltage of the sub-pixel in the current frame is equal to a preset reference Gamma voltage V1; a sixth determination circuit configured to determine, in response to that the compensation grayscale (a) is greater than the maximum grayscale M, that the grayscale compensation coefficient k1 is equal to 1, and the actual grayscale G2 of the sub-pixel in the current frame is equal to the theoretical grayscale G1; and a seventh determination circuit configured to determine the Gamma voltage compensation coefficient k2 of the sub-pixel according to the formula:

$$k2 = \sqrt{\frac{1}{(1-p)}}.$$

The voltage generating sub-circuit includes: a third generation circuit configured to generate a data voltage corresponding to the actual grayscale G2 in a case where a Gamma voltage is the reference Gamma voltage V1; a fourth calculation circuit configured to calculate an actual Gamma voltage V2 of the sub-pixel in the current frame according to the Gamma voltage compensation coefficient k2 of the sub-pixel and the reference Gamma voltage V1, wherein V2=k2×V1; and a fourth generation circuit configured to generate a data voltage corresponding to the theoretical grayscale G1 in a case where the Gamma voltage is the actual Gamma voltage V2.

In some embodiments, the system further includes a judgment circuit configured to, for each sub-pixel, determine whether the current aging degree coefficient of the sub-pixel is greater than a predetermined aging degree coefficient threshold before the aging compensation circuit begins to work; in response to the current aging degree coefficient of the sub-pixel is not greater than a predetermined aging degree coefficient threshold, the aging compensation circuit performs aging compensation on the sub-pixel according to the current aging degree coefficient of the sub-pixel; otherwise, determining the sub-pixel as an abnormal sub-pixel.

As a third aspect, a display device including the above system is provided.

As a fourth aspect, an apparatus is provided. The apparatus includes: a memory and one or more processors; wherein the memory and the one or more processors are connected with each other; and the memory stores computer-executable instructions for controlling the one or more processors to: respectively determining a current aging degree coefficient of each sub-pixel according to historical display data of the sub-pixel; and for each sub-pixel, performing aging compensation on the sub-pixel according to the current aging degree coefficient of the sub-pixel when a current frame is displayed.

DETAILED DESCRIPTION

In order to enable those skilled in the art to better understand the technical solutions of the present disclosure, a compensation method for a display panel, a compensation system for a display panel, and a display device provided in the present disclosure are described below in detail with reference to the accompanying drawings.

In general, the aging of OLEDs is compensated for in a following way: firstly, determining a coefficient of an overall aging degree of a display panel according to usage time of the display panel; then, determining an aging compensation parameter based on the overall aging degree; and finally, compensating each pixel unit of the display panel according to the same aging compensation parameter.

According to the above aging compensation, all the pixel units of the display panel are compensated according to the same aging compensation parameter. However, aging degrees of the OLEDs in different pixel units of the display panel are different in practical application, which results in a poor compensation effect when compensating according to the same aging compensation parameter.

Figure 1:
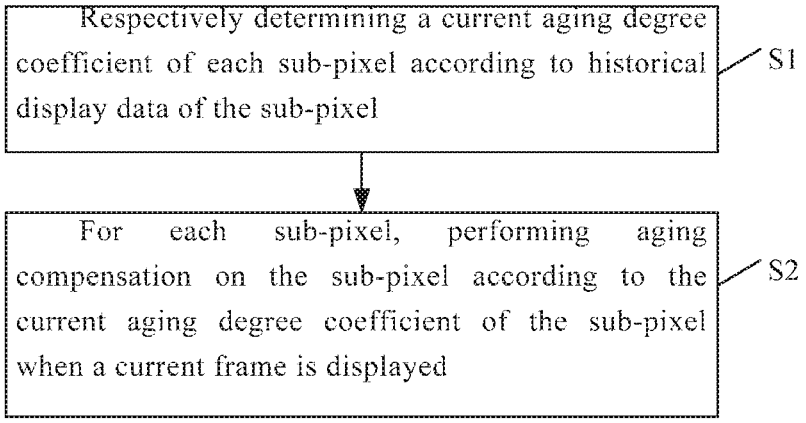
FIG. 1 is a flowchart illustrating a compensation method for a display panel according to an embodiment of the present disclosure.

FIG. 1 is a flowchart illustrating a compensation method for a display panel according to an embodiment of the present disclosure. As shown in FIG. 1, a display panel includes a plurality of sub-pixels, the sub-pixel generally includes a pixel driving circuit and an OLED, and the pixel driving circuit is configured to drive the OLED to emit light according to a received data voltage. In the present disclosure, the "current aging degree coefficient of each sub-pixel" actually refers to a current aging coefficient of an OLED in each sub-pixel.

The compensation method for a display panel provided by the present disclosure includes:

Step S1, a current aging degree coefficient of each sub-pixel is separately determined according to historical display data of the sub-pixel.

It should be noted that the "historical display data" in the present disclosure refers to the display data of each sub-pixel in all frames displayed on the display panel during a period from a preset time point to a previous frame before a current frame. The preset time point may be selected and set according to actual needs. In the embodiments of the present disclosure, a time point at which the display panel is started up for the first time is taken as an example of the "preset time point" for exemplary description, but the technical solutions of the present disclosure are not limited to such example.

In addition, the "previous frame" and the "current frame" are two adjacent frames in the present disclosure, and the "current aging degree coefficient of each sub-pixel" in the present disclosure refers to an aging degree coefficient of each sub-pixel until the previous frame has been displayed but the current frame is not displayed. The aging degree coefficient is used to reflect an aging degree, and is generally defined as a ratio of a difference between a performance index before aging and the performance index after aging to the performance index before aging; the performance index may be luminance, luminous efficiency, service life or other parameter. The luminance of a sub-pixel in a standard test environment is usually selected as the performance index of the sub-pixel in practical application. A value of the aging degree coefficient falls into a range of [0, 1], the larger the value, the more serious the aging degree.

The applicant has found that the aging degree of a sub-pixel is not only influenced by its usage time, but also influenced by its display brightness the sub-pixel in practical application. In general, the higher the display brightness of the sub-pixel, the faster the aging develops.

Based on the above phenomenon, in the present disclosure, the current aging degree coefficient of each sub-pixel is determined by using the historical display data of the sub-pixel during a period from the first startup of the display panel to the displaying of the previous frame as basic data, and using each sub-pixel as a discrete point. That is, when determining the current aging degree coefficient of a sub-pixel, an influence of the usage time on the aging degree of the sub-pixel is considered, and an influence of the display data on the aging degree of the sub-pixel is also considered. Therefore, with the technical solutions of the present disclosure, the current aging degree coefficient of each sub-pixel when/until a previous frame is finished may be accurately obtained.

Figure 2:
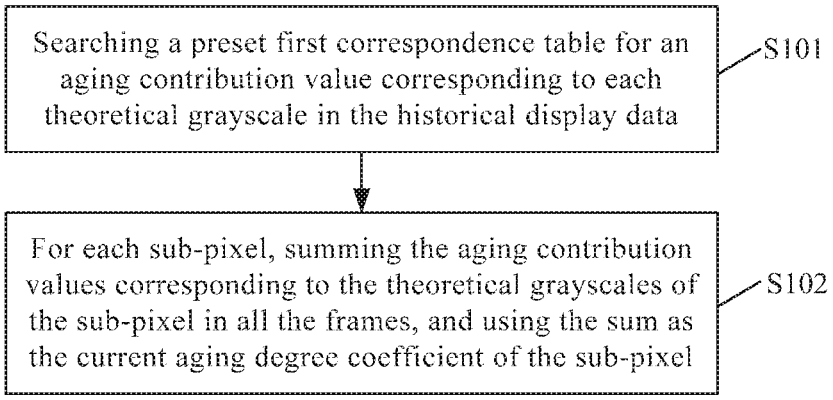
FIG. 2 is a flowchart of step S1 of the present disclosure.

FIG. 2 is a flowchart of step S of the present disclosure. As shown in FIG. 2, according to an embodiment, the step S1 includes the following steps S101 and S102.

At step S101, a preset first correspondence table is searched for aging contribution values corresponding to theoretical grayscales in the historical display data.

It should be noted that the "theoretical grayscale" in the present disclosure refers to the grayscale of a sub-pixel determined according to multimedia data streams when a display device receives the multimedia data streams, and the grayscale can reflect a grayscale which a sub-pixel is expected to have in a case where the aging problem of the sub-pixel is not taken into account.

In the present disclosure, the first correspondence table may be generated through a preliminary experiment, and stores different theoretical grayscales and aging contribution values corresponding the theoretical grayscales.

The "aging contribution value corresponding to each theoretical grayscale" in the present disclosure refers to a variation value of an aging degree coefficient of a sub-pixel during one frame during which the sub-pixel displays with the theoretical grayscale (the variation value is a difference between the aging degree coefficient at the end of the frame and the aging degree coefficient at the beginning of the frame). The aging contribution values corresponding to the theoretical grayscales can be set according to the preliminary experiment.

Taking setting the aging contribution values corresponding to theoretical grayscale L255 as an example, a new display panel is selected, each sub-pixel of the display panel is controlled to display 10,000 frames with grayscale L255, it is detected that the display brightness of the display panel when displaying the $1^{st}$ frame and the display brightness when displaying the $10{,}000^{th}$ frame are Q1 and Q2 respectively, then the aging contribution value corresponding to grayscale L255 may be set to be:

$$\frac{Q1 - Q2}{10000 * Q1}.$$

The whole display panel, instead of a single sub-pixel, is selected as the detected object in the above example, so as to facilitate the detection of display brightness, and avoid the problem of low accuracy of the aging contribution values due to large experimental errors caused by a single sub-pixel.

It should be noted that, the above way of obtaining the aging contribution values corresponding to grayscale L225 is merely an optional embodiment of the present disclosure, and does not limit the technical solutions of the present disclosure, and the aging contribution value corresponding to each theoretical grayscale can also be obtained in other ways in the present disclosure. For example, a time-display brightness relationship curve corresponding to each theoretical grayscale is obtained, and the aging contribution value corresponding to each theoretical grayscale is set based on the relationship curve corresponding to the theoretical grayscale. The other ways for setting the aging contribution value corresponding to each theoretical grayscale will not be illustrated here one by one.

Table 1 below shows an example of the first correspondence table in the present disclosure, as shown in Table 1.

TABLE 1

First correspondence table in the present disclosure

| Theoretical grayscale | Aging contribution value |
|---|---|
| 0 | A0 |
| 1 | A1 |
| 2 | A2 |
| . . . | . . . |
| 255 | A255 |

Table 1 only exemplarily shows the case where there are 2 theoretical grayscales (grayscales 0 to 255), with A0 to A255 all being values greater than 0 and less than 1. In Table 1, an aging contribution value corresponding to the maximum theoretical grayscale is greater than an aging contribution value corresponding to the minimum theoretical grayscale. Among any two adjacent theoretical grayscales, an aging contribution value corresponding to the larger theoretical grayscale is greater than or equal to an aging contribution value corresponding to the smaller theoretical grayscale, that is, the aging contribution values increase with the increase of the theoretical grayscales.

At step S101, based on the historical display data and the first correspondence table, the aging contribution values corresponding to the theoretical grayscales of each sub-pixel in each of all the frames displayed on the display panel from the first startup of the display panel to the displaying of the previous frame may be found.

At step S102, for each sub-pixel, the aging contribution values corresponding to the theoretical grayscales of the sub-pixel for all the frames are summed, and the sum is used as the current aging degree coefficient of the sub-pixel.

In the step S102, for each sub-pixel, by summing the aging contribution values corresponding to the theoretical grayscales of the sub-pixel for all the frames, the current aging degree coefficient of the sub-pixel until the previous frame has been displayed but the current frame is not displayed may be obtained.

For example, a display panel includes M sub-pixels, assuming that the "previous frame" is the $R^{th}$ frame displayed after the first startup of the display panel, the current aging degree coefficient of the $J^{th}$ sub-pixel of the display panel is $$p_J = \sum_{i=1}^{R} B_{J_i},$$

Where $p_J$ represents the current aging degree coefficient of the $J^{th}$ sub-pixel, and $B_{j_i}$ represents the aging contribution value corresponding to the theoretical grayscale of the $J^{th}$ sub-pixel for the $i^{th}$ frame.

At step S102, the aging contribution values of the M sub-pixels need to be calculated respectively.

At step S2, when a current frame is displayed, for each sub-pixel, aging compensation is performed to the sub-pixel according to the current aging degree coefficient of the sub-pixel.

In the present disclosure, aging compensation is performed based on the current aging degree coefficient of each sub-pixel obtained in the step S1 during the displaying of the current frame. The technical solutions of the present disclosure can compensate for aging differently according to different aging degrees of different sub-pixels of a display panel, therefore the aging compensation method provided by the present disclosure can have a better compensation effect in comparison with the related art.

Figure 3:
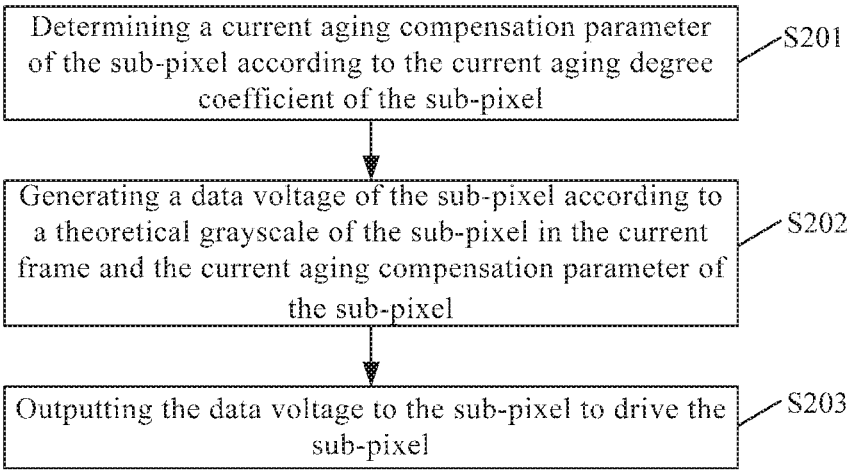
FIG. 3 is a flowchart of step S2 of the present disclosure.

FIG. 3 is a flowchart of step S2 of the present disclosure. As shown in FIG. 3, each sub-pixel of the display panel may be compensated as follows. The step S2 includes steps S201 to S203.

At step S201, a current aging compensation parameter of the sub-pixel is determined according to the current aging degree coefficient of the sub-pixel.

At step S202, a data voltage of the sub-pixel is generated according to a theoretical grayscale of the sub-pixel in the current frame and the current aging compensation parameter of the sub-pixel.

Figure 4:
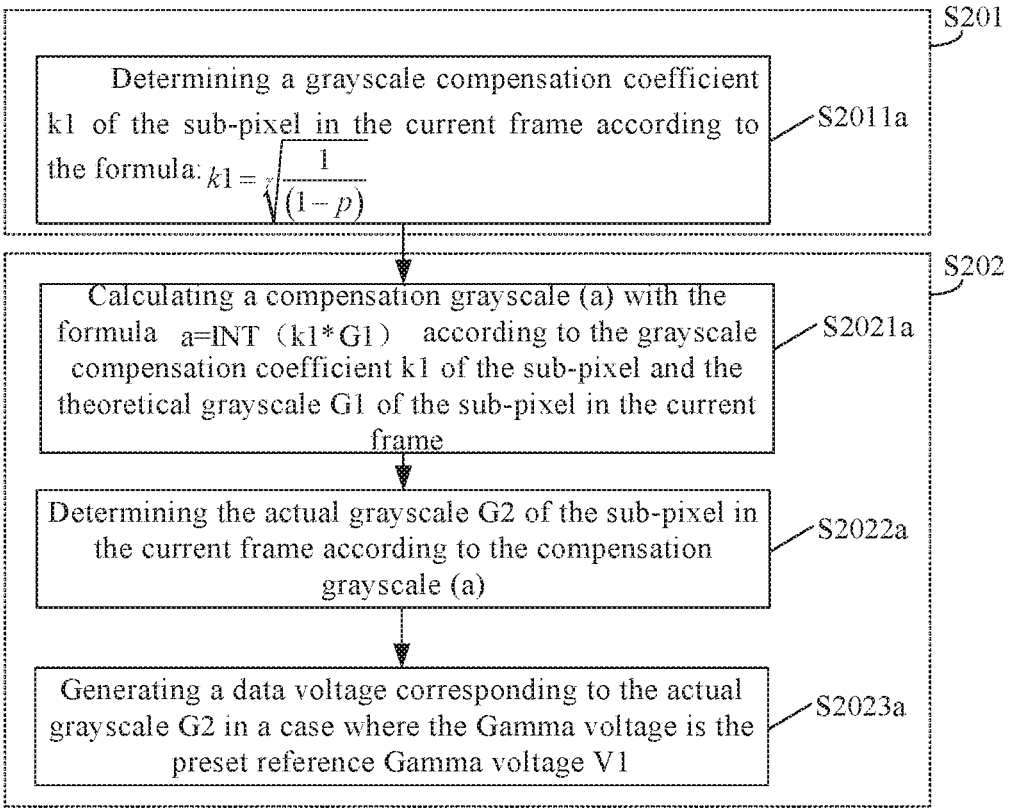
FIG. 4 is a flowchart of steps S201 and S202 of the present disclosure.

FIG. 4 is a flowchart of steps S201 and S202 of the present disclosure. According to an embodiment, as shown in FIG. 4, the current aging compensation parameter includes a grayscale compensation coefficient k1, which represents a ratio of an actual grayscale of the sub-pixel to the theoretical grayscale of the sub-pixel during the displaying of the current frame; and only grayscales are adjusted for performing aging compensation according to this technical solution.

The step S201 includes the following step S2011*a*.

At step S2011*a*, a grayscale compensation coefficient k1 of the sub-pixel in/for the current frame is determined according to the formula:

$$k1 = \sqrt[\gamma]{\frac{1}{(1-p)}},$$

Where p represents the current aging degree coefficient of the sub-pixel, and γ represents a preset Gamma coefficient of the display panel.

In the present disclosure, the grayscale G and the display brightness U satisfy the following relation:

$$U = L0 * \left(\frac{G}{2^N - 1}\right)^{\gamma}$$

Where $2^N$ represents the brightness levels at which a sub-pixel can display (for example, when N is equals to 8, a sub-pixel can display with 256 different grayscales: grayscales in a range from 0 to 255), $(2^N-1)$ represents a maximum grayscale, L0 represents a display brightness corresponding to the maximum grayscale in a case where a Gamma voltage is set (for example, when N is 8, L0 represents the display brightness of a sub-pixel with the grayscale is 255), the magnitude of L0 is determined by a Gamma voltage, L0 is proportional to a square of the Gamma voltage, and γ represents the Gamma coefficient (usually γ=2.2).

In the present disclosure, assuming that the display brightness corresponding to the maximum grayscale is L1 when the Gamma voltage is a preset reference Gamma voltage V1 (a Gamma voltage initially set in the display panel), if an influence of aging on a sub-pixel is not considered, a display brightness U1 corresponding to a theoretical grayscale G1 satisfies:

$$U1 = L1 * \left(\frac{G1}{2^N - 1}\right)^{\gamma} \ldots \quad (1)$$

However, luminance of a sub-pixel is affected by an aging degree of the sub-pixel in actual displaying. In the embodiment, in a case where the current aging degree coefficient is P, assuming that an actual grayscale obtained after grayscale is adjusted is G2, a display brightness U2 corresponding to the actual grayscale G2 satisfies:

$$U2 = L1 * \left(\frac{G2}{2^N - 1}\right)^{\gamma} * (1-p) \ldots \quad (2)$$

Since U1=U2, it can be deduced from the formulae (1) and (2) that:

$$\frac{G2}{G1} = \sqrt[\gamma]{\frac{1}{(1-p)}} = k1$$

Thus, the grayscale compensation coefficient k1 of the sub-pixel in the current frame can be obtained in the step S2011*a*.

The step S202 includes the following steps S2021*a*. S2022*a*, and S2023*a*.

At step S2021*a*, a compensation grayscale (a) is calculated by using the formula a=INT(k1*G1) according to the grayscale compensation coefficient k1 of the sub-pixel and the theoretical grayscale G1 of the sub-pixel for the current frame, Where INT(k1*G1) represents rounding k1*G1. In the present disclosure, the rounding may be rounded up, rounded down, or rounded toward the nearest number, but the technical solutions of the present disclosure do not make any limitation to the rounding algorithms.

At step S2022*a*, the actual grayscale G2 of the sub-pixel in the current frame is determined according to the compensation grayscale (a):

$$G2 = \begin{cases} a & a \le M \\ M & a > M \end{cases},$$

where M represents a preset maximum grayscale of the sub-pixel.

At step S2022*a*, the compensation grayscale (a) is compared with the preset maximum grayscale, when the compensation grayscale (a) is less than or equal to the maximum grayscale M, the compensation grayscale (a) serves as an actual grayscale G2 for final compensation; otherwise, the maximum grayscale M serves as an actual grayscale G2 for final compensation.

At step S2023*a*, a data voltage corresponding to the actual grayscale G2 is generated in a case where the Gamma voltage is the preset reference Gamma voltage V1.

It should be noted that the process of generating a data voltage corresponding to a grayscale according to the determined Gamma voltage belongs to conventional technical means in the art, and thus will not be repeated here.

Figure 5:
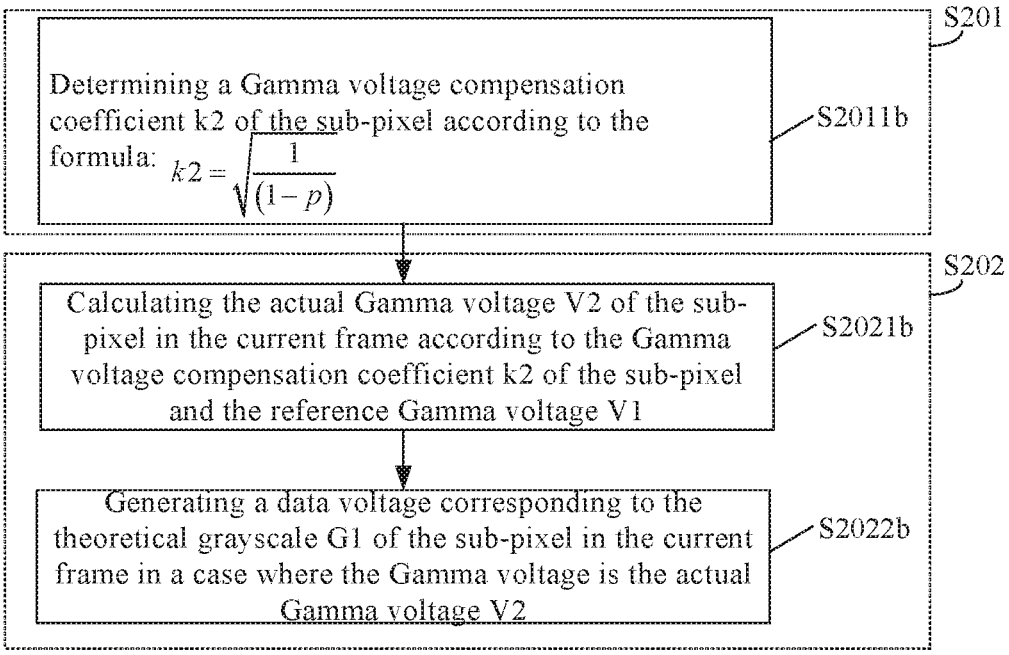
FIG. 5 is a flowchart of steps S201 and S202 of the present disclosure.

FIG. 5 is a flowchart of steps S201 and S202 of the present disclosure. According to an embodiment, as shown in FIG. 5, the current aging compensation parameter includes a Gamma voltage compensation coefficient k2, which represents a ratio of an actual Gamma voltage of the sub-pixel during the the current frame is displayed to a preset reference Gamma voltage; and only Gamma voltages are adjusted for performing aging compensation according to this technical solution.

In the embodiment, the step S201 includes the following step S2011*b*.

At step S2011*b*, a Gamma voltage compensation coefficient k2 of the sub-pixel is determined according to the formula:

$$k2 = \sqrt{\frac{1}{(1-p)}},$$

Where p represents the current aging degree coefficient of the sub-pixel, and γ represents a preset Gamma coefficient of the display panel.

It can be known from the above description that the display brightness corresponding to the maximum grayscale is L1 when the Gamma voltage is the preset reference Gamma voltage V1. In a case where an influence of aging on a sub-pixel is not considered, a display brightness U1 corresponding to a theoretical grayscale G1 satisfies:

$$U1 = L1 * \left(\frac{G1}{2^N - 1}\right)^{\gamma} \ldots \quad (3)$$

In the embodiment, assuming that an actual Gamma voltage obtained is V2 after Gamma voltage is adjusted, a display brightness corresponding to the maximum grayscale is L2, and the current aging coefficient is P, a display brightness U3 corresponding to the theoretical grayscale G1 satisfies:

$$U3 = L2 * \left(\frac{G1}{2^N - 1}\right)^{\gamma} * (1 - p) \ldots \quad (4)$$

Since U1=U3, it can be obtained from the formulae (3) and (4) that:

$$\frac{L2}{L1} = \frac{1}{(1 - p)}$$

Moreover, since $$\frac{L1}{V1^2} = \frac{L2}{V2^2},$$

it can be obtained that $$\frac{V2}{V1} = \sqrt{\frac{L2}{L1}} = \sqrt{\frac{1}{(1 - p)}} = k2.$$

The Gamma voltage compensation coefficient k2 of the sub-pixel in the current frame can be obtained in the step S2011*b*.

The step S202 includes the following steps S2021*b* and S2022*b*.

At step S2021*b*, the actual Gamma voltage V2 of the sub-pixel in the current frame is calculated according to the Gamma voltage compensation coefficient k2 of the sub-pixel and the reference Gamma voltage V1, with V2=k2×V1.

At step S2022*b*, a data voltage corresponding to the theoretical grayscale G1 of the sub-pixel in the current frame is generated in a case where the Gamma voltage is the actual Gamma voltage V2.

Since the Gamma voltages are adjusted while the grayscales are not adjusted according to this technical solution, this technical solution of compensation may be applied to different grayscales.

Figure 6:
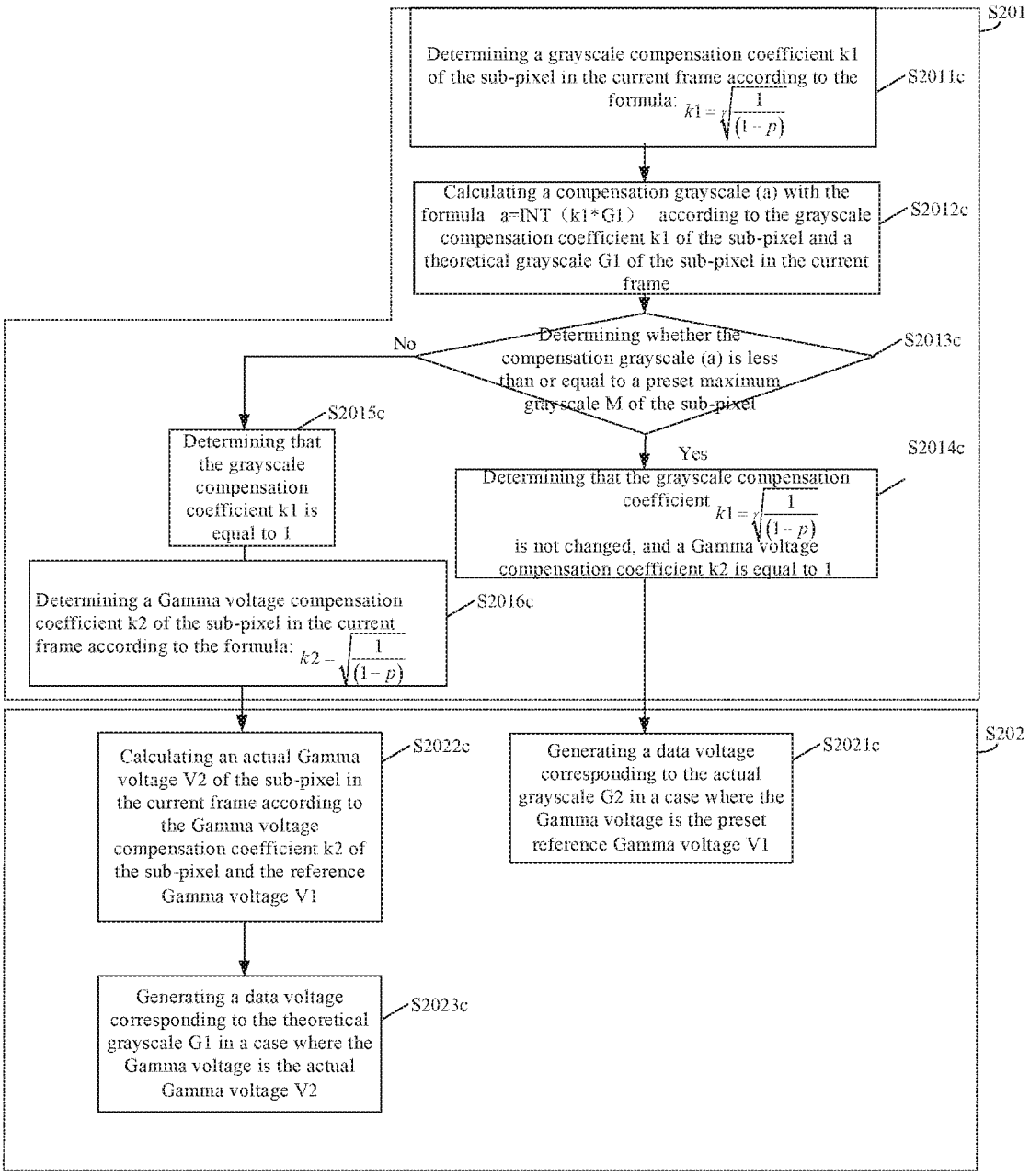
FIG. 6 is a flowchart of steps S201 and S202 of the present disclosure.

FIG. 6 is a flowchart of steps S201 and S202 of the present disclosure. According to an embodiment, as shown in FIG. 6, the current aging compensation parameter includes a grayscale compensation coefficient k1 and a Gamma voltage compensation coefficient k2. The grayscale compensation coefficient k1 represents a ratio of an actual grayscale of the sub-pixel to the theoretical grayscale of the sub-pixel during the displaying of the current frame, and the Gamma voltage compensation coefficient k2 represents a ratio of an actual Gamma voltage of the sub-pixel during the displaying of the current frame to a preset reference Gamma voltage. According to this technical solution, either a grayscale or a Gamma voltage is selected to be adjusted based on an aging degree and a theoretical grayscale of a sub-pixel.

The step S201 includes the following steps S2011*e* to S2016*c*.

At step S2011*c*, a grayscale compensation coefficient k1 of the sub-pixel in the current frame is determined according to the formula:

$$k1 = \sqrt[\gamma]{\frac{1}{(1 - p)}},$$

Where p represents the current aging degree coefficient of the sub-pixel, and γ represents a preset Gamma coefficient of the display panel; and the principle of determining the grayscale compensation coefficient k1 can be found in the above description, and will not be repeated here.

At step S2012*c*, a compensation grayscale (a) is calculated by using the formula a=INT(k1*G1) according to the grayscale compensation coefficient k1 of the sub-pixel and a theoretical grayscale G1 of the sub-pixel in the current frame.

Where INT(k1*G1) represents rounding k1*G1.

At step S2013*c*, whether the compensation grayscale (a) is less than or equal to a preset maximum grayscale M of the sub-pixel is determined.

When it is determined that the compensation grayscale (a) is less than or equal to the maximum grayscale M, which indicates that accurate compensation may be carried out by adjusting grayscales, step S2014*c* is then performed; otherwise, it indicates that the adjusting grayscales accurate compensation cannot be achieved by adjusting grayscales, and accurate compensation may be carried out by adjusting Gamma voltages, so that step S2015*c* is then performed.

At step S2014*c*, it is determined that the grayscale compensation coefficient $$k1 = \sqrt[\gamma]{\frac{1}{(1 - p)}}$$

remains unchanged, and a Gamma voltage compensation coefficient k2 is equal to 1.

According to the coefficients determined in the step S2014*c*, it may be figured out that an actual grayscale G2 of the sub-pixel in the current frame is equal to the compensation grayscale (a), and a grayscale voltage of the sub-pixel in the current frame is equal to a preset reference Gamma voltage V1. The following step S2021*c* is carried out after the step S2014*c*.

According to the embodiment, the step S202 includes the following step S2021*c*.

At step S2021*c*, a data voltage corresponding to the actual grayscale G2 is generated in a case where the Gamma voltage is the preset reference Gamma voltage V1.

At step S2015*c*, the grayscale compensation coefficient k1 is determined to be 1.

The actual grayscale G2 of the sub-pixel in the current frame is equal to the theoretical grayscale G1 according to the coefficient determined in the step S2015*c*.

At step S2016*c*, a Gamma voltage compensation coefficient k2 of the sub-pixel is determined according to the formula:

$$k2 = \sqrt{\frac{1}{(1-p)}}.$$

The following step S2022*c* is carried out after the step S2016*c*.

The principle of determining the Gamma voltage compensation coefficient k2 can be found in the above description, and will not be repeated here.

According to the embodiment, the step S202 includes the following steps S2022*c* and S2023*c*.

At step S2022*c*, an actual Gamma voltage V2 of the sub-pixel in the current frame is calculated according to the Gamma voltage compensation coefficient k2 of the sub-pixel and the reference Gamma voltage V1, with V2=k2×V1.

At step S2023*c*, a data voltage corresponding to the theoretical grayscale G1 is generated in a case where the Gamma voltage is the actual Gamma voltage V2.

It should be noted that the implementation in which the current aging compensation parameter is determined according to the current aging degree coefficient and the data voltage is generated according to the current aging compensation parameter is not limited to the above embodiments in the present disclosure. The present disclosure may adopt other ways of determining the current aging compensation parameter according to the current aging degree coefficient and generating the corresponding data voltage. For example, a table showing a correspondence between current aging degree coefficients and current aging compensation parameters, and a table showing a correspondence between current aging compensation parameters and theoretical grayscales and the data voltages (a combination of the two parameters (i.e., "the current aging compensation parameter" and "the theoretical grayscale") corresponds to one "data voltage") are created in advance, and a corresponding data voltage can be obtained by looking up the two tables twice. The other implementations will not be illustrated here one by one.

In addition, the data voltage signals generated in the step S202 are digital signals.

At step S203, the corresponding data voltage is output into the sub-pixel to drive the sub-pixel.

At step S203, the digital signal generated in the step S202 is converted into an analog signal, that is, the data voltage signal output in the step S203 is an analog signal, and the analog signal arrives at a corresponding sub-pixel in a corresponding time sequence through a data line. The corresponding sub-pixel receives a compensated data voltage and displays with the received data voltage, so that aging compensation of the sub-pixel is achieved.

Figure 7:
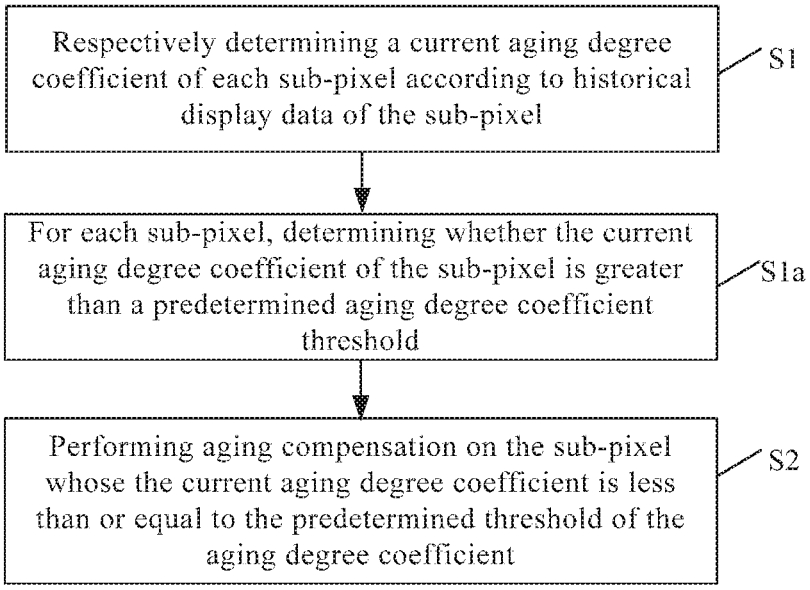
FIG. 7 is a flowchart illustrating a compensation method for a display panel according to an embodiment of the present disclosure.

FIG. 7 is a flowchart illustrating a compensation method for a display panel according to an embodiment of the present disclosure. As shown in FIG. 7, unlike the compensation method in the above embodiments, the compensation method according to this embodiment includes steps S1 and S2, and further includes step S1*a* between the step S1 and the step S2. Reference may be made to the description of the above embodiments for specific description of the steps S1 and S2 of this embodiment, and only the step S1*a* is described in detail in this embodiment.

At step S1*a*, for each sub-pixel, whether the current aging degree coefficient of the sub-pixel is greater than a predetermined aging degree coefficient threshold is determined.

According to the embodiment, a predetermined aging degree coefficient threshold may be set in advance, and whether a sub-pixel can be continuously used may be determined based on the predetermined aging degree coefficient threshold.

At step S1*a*, for a sub-pixel, when it is determined that the current aging degree coefficient of the sub-pixel is not greater than the predetermined aging degree coefficient threshold, which indicates that the sub-pixel has a low aging degree and can be used continuously, aging compensation may be performed on the sub-pixel in the step S2. Otherwise, it indicates that the aging degree of the sub-pixel is relatively serious and the sub-pixel cannot be used anymore, so that the sub-pixel is determined to be an abnormal sub-pixel, and is not subject to aging compensation in the step S2.

In the technical field of display, when the luminance of a sub-pixel in a standard test environment is reduced to half of the luminance before aging, the sub-pixel is generally considered to be at the end of its service life; and therefore, the predetermined aging degree coefficient threshold may be set to 50% of the luminance. However, as long as the predetermined aging degree coefficient threshold is in a range of (0, 1], the predetermined aging degree coefficient threshold may also be adjusted as actual needs.

In addition, it is possible to set a threshold of a total number of abnormal sub-pixels in practical application, so that it may be determined that the overall aging degree of a display panel is so serious that the display panel cannot be used normally, when the total number of abnormal sub-pixels of the display panel is greater than the threshold.

Figure 8:
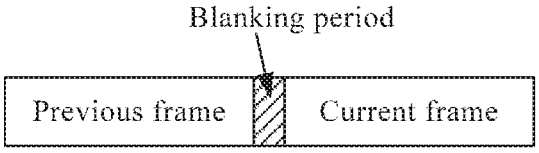
FIG. 8 is a schematic diagram of time periods during which a display panel displays two successive frames.

FIG. 8 is a schematic diagram of time periods when a display panel displays two successive frames. As shown in FIG. 8, when a display panel displays two successive frames, a time period from the end of a previous frame to the beginning of a current frame is a blanking period. The compensation method provided by the present disclosure is performed during the blanking period to provide a corresponding compensated data voltage for each sub-pixel of the display panel. When the current frame begins to be displayed, all the sub-pixels display according to the received data voltages to present a complete current frame, that is, thereby achieving aging compensation of the display panel.

In practical application, after the display of the current frame is finished, the current frame may be regarded as "the previous frame", the next frame to be displayed may be regarded as "the current frame", and the above aging compensation method is performed again. By repeating the above process, aging compensation may be performed for every frame displayed by a display device.

Figure 9:
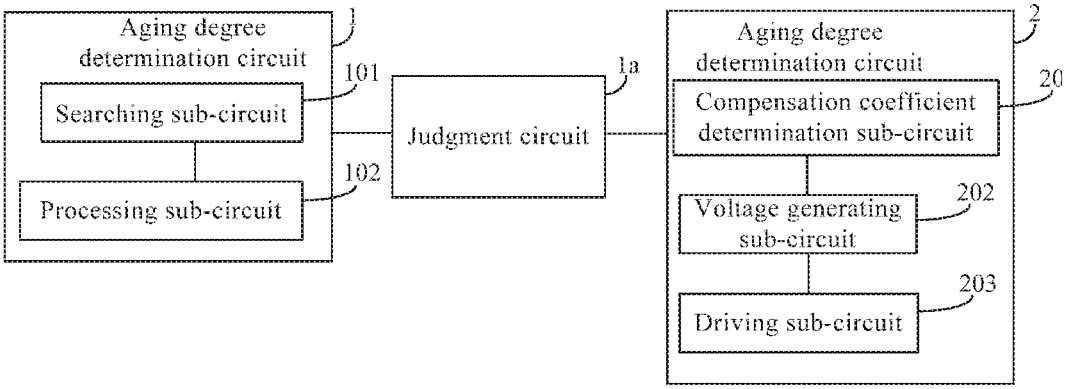
FIG. 9 is a block diagram illustrating a structure of a compensation system for a display panel according to an embodiment of the present disclosure.

FIG. 9 is a block diagram illustrating a structure of a compensation system for a display panel according to an embodiment of the present disclosure. As shown in FIG. 9, the compensation system may be configured to perform the compensation method according to the above embodiments, and includes an aging degree determination circuit 1 and an aging compensation circuit 2.

The aging degree determination circuit 1 is configured to respectively determine a current aging degree coefficient of each sub-pixel according to historical display data of the sub-pixel.

The aging compensation circuit 2 is configured to, for each sub-pixel, perform aging compensation to the sub-pixel according to the current aging degree coefficient of the sub-pixel when a current frame is displayed.

It should be noted that the aging degree determination circuit 1 in the embodiment may be configured to perform the step S1 of the above embodiments, and the aging compensation circuit 2 in the embodiment may be configured to perform the step S2 of the above embodiments.

In one embodiment, the historical display data includes a theoretical grayscale of each sub-pixel in each of the frames displayed on a display panel. The aging degree determination circuit 1 includes a searching sub-circuit 101 and a processing sub-circuit 102.

The searching sub-circuit 101 is configured to search a preset first correspondence table for an aging contribution value corresponding to each theoretical grayscale in the historical display data. The first correspondence table stores different theoretical grayscales and aging contribution values corresponding the different theoretical grayscales.

The processing sub-circuit 102 is configured to, for each sub-pixel, sum the aging contribution values corresponding to the theoretical grayscales of the sub-pixel for all the frames, and use the sum as the current aging degree coefficient of the sub-pixel.

It should be noted that the searching sub-circuit 101 in the embodiment may be configured to perform the step S101 of the above embodiments, and the processing sub-circuit 102 in the embodiment may be configured to perform the step S102 of the above embodiments. In addition, the searching sub-circuit 101 and the processing sub-circuit 102 in the present disclosure may be integrated into a timing controller of the associated display panel. The timing controller is capable of receiving multimedia data streams and determining the grayscale of each sub-pixel; moreover, the timing controller is capable of generating a corresponding data voltage (i.e., digital signal) according to a Gamma voltage and a grayscale, and transmitting the data voltage to a source driver for the source driver to generate a corresponding analog signal according to the digital signal.

In one embodiment, the aging compensation circuit 2 includes a compensation coefficient determination sub-circuit 201, a voltage generating sub-circuit 202 and a driving sub-circuit 203.

The compensation coefficient determination sub-circuit 201 is configured to, for each sub-pixel, determine a current aging compensation parameter of the sub-pixel according to the current aging degree coefficient of the sub-pixel.

The voltage generating sub-circuit 202 is configured to generate a data voltage of the sub-pixel according to a theoretical grayscale of the sub-pixel in the current frame and the current aging compensation parameter of the sub-pixel.

The driving sub-circuit 203 is configured to output the corresponding data voltage to the sub-pixel to drive the sub-pixel.

It should be noted that the compensation coefficient determination sub-circuit 201 in the embodiment may be configured to perform the step S201 of the above embodiments, the voltage generating sub-circuit 202 may be configured to perform the step S202 of the above embodiments, and the driving sub-circuit 203 may be configured to perform the step S203 of the above embodiments. In addition, the compensation coefficient determination sub-circuit 201 and the voltage generating sub-circuit 202 in the present disclosure may be integrated into a timing controller of the associated display device. The driving sub-circuit 203 in the present disclosure is a source driver of the associated display device, and may provide a corresponding data voltage for each sub-pixel of the display panel through a data line, so as to drive the sub-pixel. The process of driving sub-pixels with data voltages belongs to conventional technical means in the art, and thus will not be repeated here.

Figure 10:
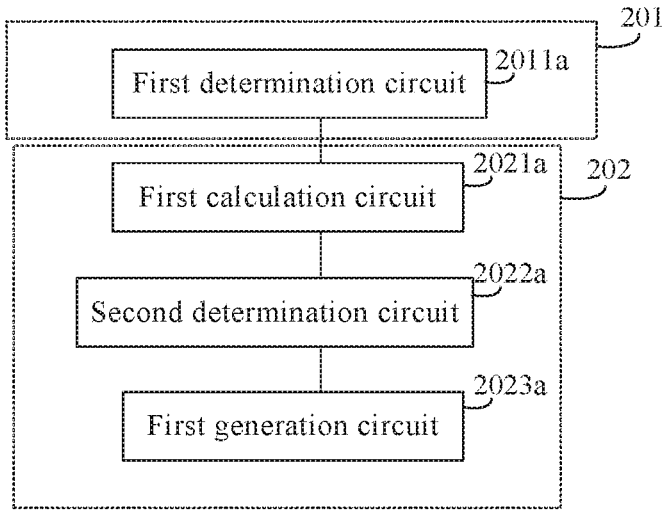
FIG. 10 is a schematic diagram illustrating structures of a compensation coefficient determination sub-circuit and a voltage generating sub-circuit in the present disclosure.

FIG. 10 is a schematic diagram illustrating structures of a compensation coefficient determination sub-circuit 201 and a voltage generating sub-circuit 202 in the present disclosure. As shown in FIG. 10, the current aging compensation parameter includes a grayscale compensation coefficient k1, which represents a ratio of an actual grayscale of the sub-pixel to a theoretical grayscale of the sub-pixel during the displaying of the current frame. The compensation coefficient determination sub-circuit 201 includes a first determination circuit 2011*a*. The voltage generating sub-circuit 202 includes a first calculation circuit 2021*a* a second determination circuit 2022*a*, and a first generation circuit 2023*a*.

The first determination circuit 2011*a* is configured to determine a grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel.

The first calculation circuit 2021*a* is configured to calculate a compensation grayscale (a) by using the formula: a=INT(k1*G1) according to the grayscale compensation coefficient k1 of the sub-pixel and a theoretical grayscale G1 of the sub-pixel in the current frame, where INT(k1*G1) represents rounding k1*G1.

The second determination circuit 2022*a* is configured to determine an actual grayscale G2 of the sub-pixel for the current frame according to the compensation grayscale (a):

$$G2 = \begin{cases} a & a \le M \\ M & a > M \end{cases},$$

where M represents a preset maximum grayscale of the sub-pixel.

The first generation circuit 2023*a* is configured to generate a data voltage corresponding to the actual grayscale G2 in a case where a Gamma voltage is a preset reference Gamma voltage.

It should be noted that the first determination circuit 2011*a* in the embodiment may be configured to perform the step S2011*a* of the above embodiment, the first calculation circuit 2021*a* may be configured to perform the step S2021*a* of the above embodiment, the second determination circuit 2022*a* may be configured to perform the step S2022*a* of the above embodiment, and the first generation circuit 2023*a* may be configured to perform the step S2023*a* of the above embodiment.

Figure 11:
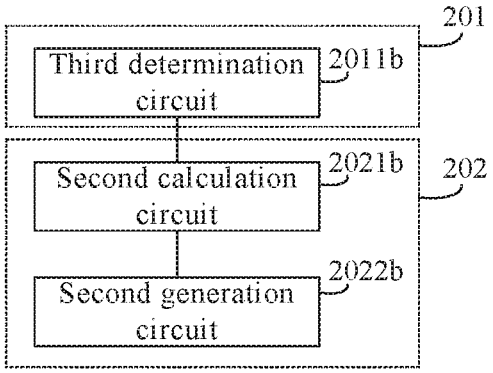
FIG. 11 is a schematic diagram illustrating structures of a compensation coefficient determination sub-circuit and a voltage generating sub-circuit in the present disclosure.

FIG. 11 is a schematic diagram illustrating structures of a compensation coefficient determination sub-circuit 201 and a voltage generating sub-circuit 202 in the present disclosure. In one embodiment, as shown in FIG. 11, the current aging compensation parameter includes a Gamma voltage compensation coefficient k2, which represents a ratio of an actual Gamma voltage of the sub-pixel during the displaying of the current frame to a preset reference Gamma voltage. The compensation coefficient determination sub-circuit 201 includes a third determination circuit 2011*b*, and a voltage generating sub-circuit 202 includes a second calculation circuit 2021*b* and a second generation circuit 2022*b*.

The third determination circuit 2011*b* is configured to determine a Gamma voltage compensation coefficient k2 of the sub-pixel according to the formula:

$$k2 = \sqrt{\frac{1}{(1-p)}},$$

where p represents the current aging degree coefficient of the sub-pixel, and γ represents a preset Gamma coefficient of the display panel.

The second calculation circuit 2021*b* is configured to calculate an actual Gamma voltage V2 of the sub-pixel in the current frame according to the Gamma voltage compensation coefficient k2 of the sub-pixel and a reference Gamma voltage V1, with V2=k2×V1.

The second generation circuit 2022*b* is configured to generate a data voltage corresponding to a theoretical grayscale of the sub-pixel in the current frame in a case where a Gamma voltage is the actual Gamma voltage V2.

It should be noted that the third determination circuit 2011*b* in the embodiment may be configured to perform the step S2011*b* of the above embodiment, the second calculation circuit 2021*b* may be configured to perform the step S2021*b* of the above embodiment, and the second generation circuit 2022*b* may be configured to perform the step S2022*b* of the above embodiment.

Figure 12:
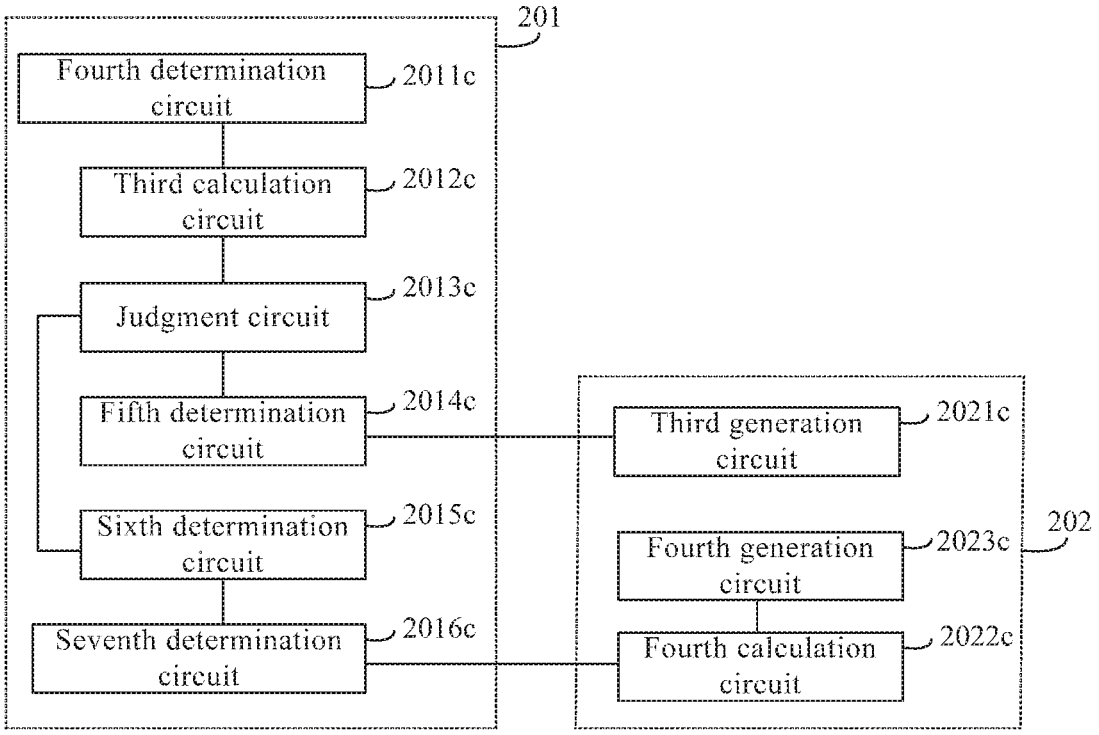
FIG. 12 is a schematic diagram illustrating structures of a compensation coefficient determination sub-circuit and a voltage generating sub-circuit in the present disclosure.

FIG. 12 is a schematic diagram illustrating structures of a compensation coefficient determination sub-circuit 201 and a voltage generating sub-circuit 202 in the present disclosure. In one embodiment, as shown in FIG. 12, the current aging compensation parameter includes a grayscale compensation coefficient k1 and a Gamma voltage compensation coefficient k2. The grayscale compensation coefficient k1 represents a ratio of an actual grayscale of the sub-pixel to a theoretical grayscale of the sub-pixel during the displaying of the current frame, and the Gamma voltage compensation coefficient k2 represents a ratio of an actual Gamma voltage of the sub-pixel during the displaying of the current frame to a preset reference Gamma voltage. The compensation coefficient determination sub-circuit 201 includes a fourth determination circuit 2011*c*, a third calculation circuit 2012*c*, a judgment circuit 2013*c*, a fifth determination circuit 2014*c*, a sixth determination circuit 2015*c*, and a seventh determination circuit 2016*c*. The voltage generating sub-circuit 202 includes a third generation circuit 2021*c*, a fourth calculation circuit 2022*c*, and a fourth generation circuit 2023*c*.

The fourth determination circuit 2011*c* is configured to determine a grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel.

The third calculation circuit 2012*c* is configured to calculate a compensation grayscale (a) by using the formula: a=INT(k1*G1) according to the grayscale compensation coefficient k1 of the sub-pixel for the current frame and a theoretical grayscale G1 of the sub-pixel for the current frame, where INT(k1*G1) represents rounding k1*G1.

The judgment circuit 2013*c* is configured to determine whether the compensation grayscale (a) is less than or equal to a preset maximum grayscale M of the sub-pixel.

The fifth determination circuit 2014*c* is configured to determine, when it is determined by the first determination circuit 2013*c* that the compensation grayscale (a) is less than or equal to the maximum grayscale M, that the grayscale compensation coefficient k1 remains unchanged, a Gamma voltage compensation coefficient k2 is equal to 1, an actual grayscale G2 of the sub-pixel in the current frame is equal to the compensation grayscale (a), and a grayscale voltage of the sub-pixel in the current frame is equal to a preset reference Gamma voltage V1.

The sixth determination circuit 2015*c* is configured to determine, when it is determined by the first determination circuit 2013*c* that the compensation grayscale (a) is greater than the maximum grayscale M, that the grayscale compensation coefficient k1 is equal to 1, and the actual grayscale G2 of the sub-pixel in the current frame is equal to the theoretical grayscale G1.

The seventh determination circuit 2016*c* is configured to determine the Gamma voltage compensation coefficient k2 of the sub-pixel according to the formula:

$$k2 = \sqrt{\frac{1}{(1-p)}}.$$

The third generation circuit 2021*c* is configured to generate a data voltage corresponding to the actual grayscale G2 in a case where a Gamma voltage is the reference Gamma voltage V1, after the grayscale compensation coefficient k1 and the Gamma voltage compensation coefficient k2 are determined by the fifth determination circuit 2014*c*.

The fourth calculation circuit 2022*c* is configured to calculate an actual Gamma voltage V2 of the sub-pixel in the current frame according to the Gamma voltage compensation coefficient k2 of the sub-pixel and the reference Gamma voltage V1 of the sub-pixel, after the grayscale compensation coefficient k1 and the Gamma voltage compensation coefficient k2 are determined by the seventh determination circuit 2016*c*, with V2=k2×V1.

The fourth generation circuit 2023*c* is configured to generate the data voltage corresponding to the theoretical grayscale G1 in a case where a Gamma voltage is the actual Gamma voltage V2 after the fourth calculation circuit 2022*c* finishes the calculation.

It should be noted that the fourth determination circuit 2011*c* in the embodiment may be configured to perform the step S2011*c* of the above embodiment, the third calculation circuit 2012*c* may be configured to perform the step S2012*c* of the above embodiment, the judgment circuit 2013*c* may be configured to perform the step S2013*c* of the above embodiment, the fifth determination circuit 2014*c* may be configured to perform the step S2014*c* of the above embodiment, the sixth determination circuit 2015*c* may be configured to perform the step S2015*c* of the above embodiment, the seventh determination circuit 2016*c* may be configured to perform the step S2016*c* of the above embodiment, the third generation circuit 2021*c* may be configured to perform the step S2021*c* of the above embodiment, the fourth calculation circuit 2022*c* may be configured to perform the step S2022*c* of the above embodiment, and the fourth generation circuit 2023*c* may be configured to perform the step S2023*c* of the above embodiment.

Referring FIG. 9, in some embodiments, the compensation system further includes a judgment circuit 1*a* configured to, for each sub-pixel, determine whether the current aging degree coefficient of the sub-pixel is greater than a predetermined aging degree coefficient threshold before the aging compensation circuit 2 begins to work. When it is determined that the current aging degree coefficient of the sub-pixel is not greater than the predetermined aging degree coefficient threshold, the aging compensation circuit 2 perform aging compensation to the sub-pixel according to the current aging degree coefficient of the sub-pixel, otherwise, the sub-pixel is determined to be an abnormal sub-pixel.

It should be noted that the judgment circuit 1*a* in the embodiment may be configured to perform the step S1*a* of the above embodiment.

In an embodiment, an apparatus is provided. The apparatus includes: a memory; one or more processors. The memory and the one or more processors are connected with each other. The memory stores computer-executable instructions for controlling the one or more processors to: respectively determining a current aging degree coefficient of each sub-pixel according to historical display data of the sub-pixel; and for each sub-pixel, performing aging compensation on the sub-pixel according to the current aging degree coefficient of the sub-pixel when a current frame is displayed.

The functions of the apparatus, circuits or units describe above can be performed by recording a program for realizing the functions of the apparatus, circuits or units according to the above described embodiment in a computer-readable recording medium, reading a program recorded on the recording medium into a computer system, and executing the program.

The "computer system" referred to here may include hardware such as an operating system (OS) and peripheral devices.

The "computer-readable recording medium" may be a writable nonvolatile memory such as a flexible disk, a magneto-optical disk, a ROM (Read Only Memory), or a flash memory, a portable medium such as a DVD (Digital Versatile Disk), or a storage device such as a hard disk built into the computer system.

"Computer-readable recording medium" also includes a medium that holds programs for a certain period of time such as a volatile memory (for example, a DRAM (Dynamic Random Access Memory)) in a computer system serving as a server or a client when a program is transmitted via a network such as the Internet or a communication line such as a telephone line.

The above program may be for realizing a part of the above-described functions.

Various circuits and units described herein may be implemented as electronic hardware, computer software, or combinations of both. Such circuits or units may be implemented or performed with a general purpose processor, a digital signal processor (DSP), an ASIC or ASSP, an FPGA or other programmable logic device, discrete gate or transistor logic, discrete hardware components, or any combination thereof designed to produce the configuration as disclosed herein. For example, such a configuration may be implemented at least in part as a hard-wired circuit, as a circuit configuration fabricated into an application-specific integrated circuit, or as a firmware program loaded into non-volatile storage or a software program loaded from or into a data storage medium as machine-readable code, such code being instructions executable by an array of logic elements such as a general purpose processor or other digital signal processing unit. A general purpose processor may be a microprocessor, but in the alternative, the processor may be any conventional processor, controller, microcontroller, or state machine. A processor may also be implemented as a combination of computing devices. e.g., a combination of a DSP and a microprocessor, a plurality of microprocessors, one or more microprocessors in conjunction with a DSP core, or any other such configuration. A software module may reside in a non-transitory storage medium such as RAM (random-access memory), ROM (read-only memory), nonvolatile RAM (NVRAM) such as flash RAM, erasable programmable ROM (EPROM), electrically erasable programmable ROM (EEPROM), registers, hard disk, a removable disk, or a CD-ROM; or in any other form of storage medium known in the art. An illustrative storage medium is coupled to the processor such the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

The embodiments of the present disclosure further provide a display device, including a compensation system, which is the compensation system provided by the above embodiments and thus will not be repeated here.

Specifically, the display device in the present disclosure may include any produce or component having a display function, such as electronic paper, an OLED display panel, a mobile phone, a tablet computer, a television, a display, a notebook computer, a digital photo frame, and a navigator.

It should be understood that the above embodiments are merely exemplary embodiments employed to illustrate the principles of the present disclosure, and the present disclosure is not limited thereto. Without departing from the spirit and essence of the present disclosure, various changes and modifications can be made by those skilled in the art, and should be considered to fall within the scope of the present disclosure.

What is claimed is:

1. A method for compensating a display panel, wherein the display panel comprises a plurality of sub-pixels, and the method comprises:

respectively determining a current aging degree coefficient of each sub-pixel according to historical display data of the sub-pixel; and, for each sub-pixel, performing aging compensation on the sub-pixel according to the current aging degree coefficient of the sub-pixel when a current frame is displayed, wherein before the step of performing aging compensation on the sub-pixel according to the current aging degree coefficient of the sub-pixel, the method further comprises:

for each sub-pixel, determining whether the current aging degree coefficient of the sub-pixel is greater than a predetermined aging degree coefficient threshold; and in response to that the current aging degree coefficient of the sun-pixel is not greater than a predetermined aging degree coefficient threshold, performing aging compensation on the sub-pixel according to the current aging degree coefficient of the sub-pixel; otherwise, determining the sub-pixel as an abnormal sub-pixel.

2. The method according to claim 1, wherein the history display data comprise a theoretical grayscale of each sub-pixel in each of frames displayed on the display panel;

the step of respectively determining the current aging degree coefficient of each sub-pixel according to the historical display data of the sub-pixel comprises:

searching a preset first correspondence table for an aging contribution value corresponding to each theoretical grayscale in the historical display data, the first correspondence table storing different theoretical grayscales and aging contribution values corresponding the different theoretical grayscales; and, for each sub-pixel, summing the aging contribution values corresponding to the theoretical grayscales of the sub-pixel in all the frames, and using the sum as the current aging degree coefficient of the sub-pixel.

3. The method according to claim 1, wherein the step of performing aging compensation on the sub-pixel according to the current aging degree coefficient of the sub-pixel comprises:

determining a current aging compensation parameter of the sub-pixel according to the current aging degree coefficient of the sub-pixel;

generating a data voltage of the sub-pixel according to a theoretical grayscale of the sub-pixel in the current frame and the current aging compensation parameter of the sub-pixel; and outputting the data voltage to the sub-pixel to drive the sub-pixel.

4. The method according to claim 3, wherein the current aging compensation parameter comprises a grayscale compensation coefficient k1, the grayscale compensation coefficient k1 representing a ratio of an actual grayscale of the sub-pixel to the theoretical grayscale of the sub-pixel during the displaying of the current frame;

the step of determining the current aging compensation parameter of the sub-pixel according to the current aging degree coefficient of the sub-pixel comprises:

determining the grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel; and the step of generating the data voltage of the sub-pixel according to the theoretical grayscale of the sub-pixel in the current frame and the current aging compensation parameter of the sub-pixel comprises:

calculating a compensation grayscale (a) with a formula: a=INT(k1*G1) according to the grayscale compensation coefficient k1 of the sub-pixel and a theoretical grayscale G1 of the sub-pixel in the current frame, where INT (k1*G1) represents rounding k1*G1;

determining an actual grayscale G2 of the sub-pixel in the current frame according to the compensation grayscale (a):

$$G2 = \begin{cases} a & a \le M \\ M & a > M \end{cases},$$

where M represents a preset maximum grayscale of the sub-pixel; and generating a data voltage corresponding to the actual grayscale G2 in a case where a Gamma voltage is a preset reference Gamma voltage.

5. The method according to claim 3, wherein the current aging compensation parameter comprises a Gamma voltage compensation coefficient k2, the Gamma voltage compensation coefficient k2 representing a ratio of an actual Gamma voltage of the sub-pixel during the displaying of the current frame to a preset reference Gamma voltage;

the step of determining the current aging compensation parameter of the sub-pixel according to the current aging degree coefficient of the sub-pixel comprises:

determining the Gamma voltage compensation coefficient k2 of the sub-pixel according to the formula:

$$k2 = \sqrt{\frac{1}{(1-p)}},$$

where p represents the current aging degree coefficient of the sub-pixel, and γ represents a preset Gamma coefficient of the display panel; and the step of generating the data voltage of the sub-pixel according to the theoretical grayscale of the sub-pixel in the current frame and the current aging compensation parameter of the sub-pixel comprises:

calculating an actual Gamma voltage V2 of the sub-pixel in the current frame according to the Gamma voltage compensation coefficient k2 of the sub-pixel and a reference Gamma voltage V1, with V2=k2×V1; and generating the data voltage corresponding to the theoretical grayscale of the sub-pixel in the current frame in a case where a Gamma voltage is the actual Gamma voltage V2.

6. The method according to claim 3, wherein the current aging compensation parameter comprises a grayscale compensation coefficient k1 and a Gamma voltage compensation coefficient k2, the grayscale compensation coefficient k1 representing a ratio of an actual grayscale of the sub-pixel to the theoretical grayscale of the sub-pixel during the displaying of the current frame, and the Gamma voltage compensation coefficient k2 representing a ratio of an actual Gamma voltage of the sub-pixel during the displaying of the current frame to a preset reference Gamma voltage;

the step of determining the current aging compensation parameter of the sub-pixel according to the current aging degree coefficient of the sub-pixel comprises:

determining a grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel;

calculating a compensation grayscale (a) with the formula: a=INT(k1*G1) according to the grayscale compensation coefficient k1 of the sub-pixel and a theoretical grayscale G1 of the sub-pixel in the current frame, where INT(k1*G1) represents rounding k1*G1;

determining whether the compensation grayscale (a) is less than or equal to a preset maximum grayscale M of the sub-pixel; and in response to that the compensation grayscale (a) is less than or equal to the maximum grayscale M, determining that the grayscale compensation coefficient k1 remains unchanged, and a Gamma voltage compensation coefficient k2 is equal to 1, an actual grayscale G2 of the sub-pixel in the current frame is equal to the compensation grayscale (a), and a grayscale voltage of the sub-pixel in the current frame is equal to a preset reference Gamma voltage V1;

the step of generating the data voltage of the sub-pixel according to the theoretical grayscale of the sub-pixel in the current frame and the current aging compensation parameter of the sub-pixel comprises:

generating a data voltage corresponding to the actual grayscale G2 in a case where a Gamma voltage is the preset reference Gamma voltage V1;

in response to that the compensation grayscale (a) is greater than the maximum grayscale M, determining that the grayscale compensation coefficient K1 is equal to 1, and the actual grayscale G2 of the sub-pixel in the current frame is equal to the theoretical grayscale G1; and determining the Gamma voltage compensation coefficient k2 of the sub-pixel according to the formula:

$$k2 = \sqrt{\frac{1}{(1-p)}};$$

the step of generating the data voltage of the sub-pixel according to the theoretical grayscale of the sub-pixel in the current frame and the current aging compensation parameter of the sub-pixel comprises:

calculating an actual Gamma voltage V2 of the sub-pixel in the current frame according to the Gamma voltage compensation coefficient k2 of the sub-pixel and the reference Gamma voltage V1, with V2=k2×V1; and generating the data voltage corresponding to the theoretical grayscale G1 in a case where the Gamma voltage is the actual Gamma voltage V2.

7. A system for compensating a display panel, wherein the display panel comprises a plurality of sub-pixels, and the system comprises:

an aging degree determination circuit configured to respectively determine a current aging degree coefficient of each sub-pixel according to historical display data of the sub-pixel;

an aging compensation circuit configured to, for each sub-pixel, perform aging compensation on the sub-pixel according to the current aging degree coefficient of the sub-pixel when a current frame is displayed, and a judgment circuit configured to, for each sub-pixel, determine whether the current aging degree coefficient of the sub-pixel is greater than a predetermined aging degree coefficient threshold before the aging compensation circuit begins to work, wherein in response to the current aging degree coefficient of the sub-pixel is not greater than a predetermined aging degree coefficient threshold, the aging compensation circuit performs aging compensation on the sub-pixel according to the current aging degree coefficient of the sub-pixel; otherwise, the judgment circuit determines the sub-pixel as an abnormal sub-pixel.

8. The system according to claim 7, wherein the historical display data comprise a theoretical grayscale of each sub-pixel in each of frames displayed on the display panel;

the aging degree determination circuit comprises:

a searching sub-circuit configured to search a preset first correspondence table for an aging contribution value corresponding to each theoretical grayscale in the historical display data, the first correspondence table storing different theoretical grayscales and aging contribution values corresponding the different theoretical grayscales; and a processing sub-circuit configured to, for each sub-pixel, sum the aging contribution values corresponding to the theoretical grayscales of the sub-pixel in all the frames, and use the sum as the current aging degree coefficient of the sub-pixel.

9. The system according to claim 7, wherein the aging compensation circuit comprises:

a compensation coefficient determination sub-circuit configured to, for each sub-pixel, determine a current aging compensation parameter of the sub-pixel according to the current aging degree coefficient of the sub-pixel;

a voltage generating sub-circuit configured to generate a data voltage of the sub-pixel according to a theoretical grayscale of the sub-pixel in the current frame and the current aging compensation parameter of the sub-pixel; and a driving sub-circuit configured to output the data voltage to the sub-pixel to drive the sub-pixel.

10. The system according to claim 9, wherein the current aging compensation parameter comprises a grayscale compensation coefficient k1, the grayscale compensation coefficient k1 representing a ratio of an actual grayscale of the sub-pixel to the theoretical grayscale of the sub-pixel during the displaying of the current frame;

the compensation coefficient determination sub-circuit comprises:

a first determination circuit configured to determine the grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel;

the voltage generating sub-circuit comprises:

a first calculation circuit configured to calculate a compensation grayscale (a) with the formula: a=INT (k1*G1) according to the grayscale compensation coefficient k1 of the sub-pixel and a theoretical grayscale G1 of the sub-pixel in the current frame, where INT (k1*G1) represents rounding k1*G1;

a second determination circuit configured to determine an actual grayscale G2 of the sub-pixel in the current frame according to the compensation grayscale (a):

$$G2 = \begin{cases} a & a \le M \\ M & a > M \end{cases},$$

where M represents a preset maximum grayscale of the sub-pixel; and a first generation circuit configured to generate a data voltage corresponding to the actual grayscale G2 in a case where a Gamma voltage is a preset reference Gamma voltage.

11. The system according to claim 9, wherein the current aging compensation parameter comprises a Gamma voltage compensation coefficient k2, the Gamma voltage compensation coefficient k2 representing a ratio of an actual Gamma voltage of the sub-pixel during the displaying of the current frame to a preset reference Gamma voltage;

the compensation coefficient determination sub-circuit comprises:

a third determination circuit configured to determine the Gamma voltage compensation coefficient k2 of the sub-pixel according to the formula:

$$k2 = \sqrt{\frac{1}{(1-p)}},$$

where p represents the current aging degree coefficient of the sub-pixel, and γ represents a preset Gamma coefficient of the display panel;

the voltage generating sub-circuit comprises:

a second calculation circuit configured to calculate an actual Gamma voltage V2 of the sub-pixel in the current frame according to the Gamma voltage compensation coefficient k2 of the sub-pixel and a reference Gamma voltage V1, wherein V2=k2×V1; and a second generation circuit configured to generate a data voltage corresponding to the theoretical grayscale of the sub-pixel in the current frame in a case where a Gamma voltage is the actual Gamma voltage V2.

12. The system according to claim 9, wherein the current aging compensation parameter comprises a grayscale compensation coefficient k1 and a Gamma voltage compensation coefficient k2, the grayscale compensation coefficient k1 representing a ratio of an actual grayscale of the sub-pixel to the theoretical grayscale of the sub-pixel during the displaying of the current frame, and the Gamma voltage compensation coefficient k2 representing a ratio of an actual Gamma voltage of the sub-pixel during the displaying of the current frame to a preset reference Gamma voltage;

the compensation coefficient determination sub-circuit comprises:

a fourth determination circuit configured to determine the grayscale compensation coefficient k1 of the sub-pixel in the current frame according to the formula:

$$k1 = \sqrt[\gamma]{\frac{1}{(1-p)}},$$

where p represents the current aging degree coefficient of the sub-pixel, and γ represents a preset Gamma coefficient of the display panel;

a third calculation circuit configured to calculate a compensation grayscale (a) with the formula: a=INT (k1*G1) according to the grayscale compensation coefficient k1 of the sub-pixel and a theoretical grayscale G1 of the sub-pixel in the current frame, where INT (k1*G1) represents rounding k1*G1;

a judgment circuit configured to determine whether the compensation grayscale (a) is less than or equal to a preset maximum grayscale M of the sub-pixel;

a fifth determination circuit configured to determine, in response to that the compensation grayscale (a) is less than or equal to the maximum grayscale M, that the grayscale compensation coefficient k1 remains unchanged, the Gamma voltage compensation coefficient k2 is equal to 1, an actual grayscale G2 of the sub-pixel in the current frame is equal to the compensation grayscale (a), and a grayscale voltage of the sub-pixel in the current frame is equal to a preset reference Gamma voltage V1;

a sixth determination circuit configured to determine, in response to that the compensation grayscale (a) is greater than the maximum grayscale M, that the grayscale compensation coefficient k1 is equal to 1, and the actual grayscale G2 of the sub-pixel in the current frame is equal to the theoretical grayscale G1;

and a seventh determination circuit configured to determine the Gamma voltage compensation coefficient k2 of the sub-pixel according to the formula:

$$k2 = \sqrt{\frac{1}{(1-p)}};$$

the voltage generating sub-circuit comprises:

a third generation circuit configured to generate a data voltage corresponding to the actual grayscale G2 in a case where a Gamma voltage is the reference Gamma voltage V1;

a fourth calculation circuit configured to calculate an actual Gamma voltage V2 of the sub-pixel in the current frame according to the Gamma voltage compensation coefficient k2 of the sub-pixel and the reference Gamma voltage V1, wherein V2=k2×V1; and a fourth generation circuit configured to generate a data voltage corresponding to the theoretical grayscale G1 in a case where the Gamma voltage is the actual Gamma voltage V2.

13. A display device, comprising the system according to claim 7.

14. An apparatus, comprising:

a memory;

one or more processors;

wherein the memory and the one or more processors are connected with each other; and the memory stores computer-executable instructions for controlling the one or more processors to:

respectively determine a current aging degree coefficient of each sub-pixel according to historical display data of the sub-pixel; and for each sub-pixel, perform aging compensation on the sub-pixel according to the current aging degree coefficient of the sub-pixel when a current frame is displayed, and before performing aging compensation on the sub-pixel according to the current aging degree coefficient of the sub-pixel, the computer-executable instructions control the one or more processors to:

for each sub-pixel, determine whether the current aging degree coefficient of the sub-pixel is greater than a predetermined aging degree coefficient threshold; and in response to that the current aging degree coefficient of the sub-pixel is not greater than a predetermined aging degree coefficient threshold, perform aging compensation on the sub-pixel according to the current aging degree coefficient of the sub-pixel; otherwise, determine the sub-pixel as an abnormal sub-pixel.

* * * * *